175-50
4/3/79 XR 4,147,223 SR

United States Patent [19] [11] 4,147,223
Patton [45] Apr. 3, 1979

[54] LOGGING-WHILE-DRILLING APPARATUS

[75] Inventor: Bobbie J. Patton, Dallas, Tex.

[73] Assignee: Mobil Oil Corporation, New York, N.Y.

[21] Appl. No.: 671,638

[22] Filed: Mar. 29, 1976

[51] Int. Cl.[2] ..... E21B 47/00
[52] U.S. Cl. ..... 175/40; 74/424.5; 175/50
[58] Field of Search ..... 175/40, 50; 251/81; 137/624.14; 340/18 NC, 18 LD, 18 FM; 74/424.5; 73/152

[56] References Cited

U.S. PATENT DOCUMENTS

| | | | |
|---|---|---|---|
| 755,051 | 3/1904 | Schmick | 74/424.5 |
| 856,405 | 6/1907 | Janson | 74/424.5 |
| 3,705,603 | 12/1972 | Hawk | 137/624.14 |
| 3,789,355 | 1/1974 | Patton | 340/18 NC X |

OTHER PUBLICATIONS

Ham, C. W. et al, Mechanics of Machinery, N.Y., McGraw-Hill, 1958, pp. 140–143, and pp. 193–197.

*Primary Examiner*—Ernest R. Purser
*Assistant Examiner*—Richard E. Favreau
*Attorney, Agent, or Firm*—C. A. Huggett; Drude Faulconer

[57] ABSTRACT

A logging-while-drilling apparatus having an asymmetrically efficient drive train for connecting a motor to a signal-generating rotary valve. The drive train includes a transmission which efficiently transmits torque from its input to its output but prevents the transmission of torque from its output to its input whereby the motor is effectively isolated from hydraulic torques produced by the valve.

2 Claims, 4 Drawing Figures

LOGGING-WHILE-DRILLING APPARATUS

BACKGROUND OF THE INVENTION

The present invention relates to a logging-while-drilling tool and more particularly relates to a drive train in a logging-while-drilling tool which utilizes a motor-actuated rotary valve positioned in the drilling fluid to generate a pressure wave signal representative of a "logged" condition.

The desirability of a system which is able to measure downhole drilling parameters and/or formation characteristics and transmit them to the surface while actual drilling of an earth well is being carried out has long been recognized. Several such systems have been proposed and are commonly referred to as "logging-while-drilling" systems. In logging-while-drilling systems, one of the major problems exists in finding the communication link necessary for telemetering the information from a downhole location and having it arrive at the surface in a meaningful condition.

In this regard, it has been proposed to telemeter the desired information by means of an acoustical pressure wave signal generated in and transmitted through the circulating mud system normally associated with well drilling operations. The pressure wave signal which is representative of a downhole condition is generated in the mud downhole near the bit by a signal-generating means and the wave travels up the hole through the mud to a signal processor at the surface. One logging-while-drilling system utilizing this basic type of telemetry is disclosed and fully described in U.S. Pat. No. 3,309,656 to John K. Godbey, issued Mar. 14, 1967.

In telemetering downhole information by means of an acoustical pressure wave signal carried through the mud, as mentioned above, one important consideration is how the information is actually encoded into the continuous wave signal. One system for encoding information to such a signal is disclosed and fully described in U.S. Pat. No. 3,789,355 to B. J. Patton, issued Jan. 29, 1974. This system includes a rotary valve driven at a constant speed to produce a continuous phase-locked pressure signal in the mud stream. An electrical motor which drives the valve through a drive train responds to a signal representing a piece of measured downhole information to effect a phase shift in the pressure signal by speeding up or slowing down rotation of the valve.

The rotor and stator which form the rotary valve used in such logging-while-drilling systems inherently act as a mud turbine in the mud stream and, consequently, are subject to producing hydraulic torques which are a function of both mud parameters and valve design. It follows that the motor driving the valve must be capable of producing a maximum torque equal to the sum of (1) the torques generated due to the frictional losses in the downhole logging-while-drilling apparatus; (2) the hydraulic torque produced by the rotary valve; and (3) the torques required to maintain the speed of the valve and to accelerate and decelerate the valve to execute the necessary phase shifts. Where the rotary valve is designed to produce little or no hydraulic torque at nominal mud conditions, as is normally the case in the system described in U.S. Pat. No. 3,789,355, the drive train between the motor and the valve will normally include a speed reduction transmission which is highly efficient in transmitting torque in both directions, i.e., from the motor to the valve and from the valve to the motor. Such a drive train is disclosed in U.S. Pat. No. 3,705,603 to D. E. Hawk, issued Dec. 12, 1972.

Theoretically, however, it is more desirable to design the turbine features of the valve so that the valve itself produces sufficient hydraulic torque under nominal mud conditions to drive the valve at the speed necessary to produce the desired constant pressure signal. This, in effect, unloads the motor and leaves substantially all of the power of the motor available for acceleration and deceleration of the valve to effect the desired phase shifts of the constant pressure signal.

Unfortunately, however, when the valve is designed to produce the hydraulic torque necessary to give better motor operation, the valve also produces larger variations in said hydraulic torque as mud conditions change. With a speed reduction transmission of the type as shown in U.S. Pat. No. 3,705,603, these torque variations may generate substantial dynamic loads at the motor which, in turn, must be compensated for by the motor. Therefore, when the rotary valve is designed to generate positive torque to aid in driving the valve, it is desirable to prevent this positive torque from being transferred back through the drive train to the motor.

SUMMARY OF THE INVENTION

The present invention provides a logging-while-drilling apparatus wherein a motor and a rotary, signal-generating valve are coupled through a drive train which includes an asymmetrical efficiency speed reducing transmission which effectively isolates the motor from the hydraulic torques produced by mud flow through the valve. By describing the transmission as being asymmetrically efficient, it is meant that the transmission will transfer torque from one end to the other, i.e., from input to output, with greater efficiency than it will in the opposite direction, e.g., from output to input. The transmission in the present drive train will transfer torque from the motor to the valve with a relatively good efficiency, i.e., 50%, but will transfer substantially no torque from the valve to the motor, i.e., 0% efficiency, thereby effectively isolating the motor from the hydraulic torques produced by the valve.

With the asymmetrically efficient drive train, the rotary valve of the present logging-while-drilling apparatus can be designed so that flow of mud through the valve under nominal conditions will drive the valve at a desired speed, thereby leaving the motor of the apparatus to run only itself and to effect the necessary changes in the speed of the valve to encode information into the generated signal. Since the torque developed by the valve will not be transmitted through the asymmetrically efficient drive train to the motor, any changes in the mud parameters from said nominal conditions will not cause dynamic overloads at the motor.

Structurally, the present logging-while-drilling apparatus comprises a housing adapted to be mounted into the lower end of a drill string of an earth drilling system. A signal-generating means, i.e., a rotary valve having a slotted rotor and stator is positioned on the housing so that at least a portion of the drilling fluid flowing through the drill string will flow through the valve. A motor in the housing drives the rotor of the valve through a drive train. At least one logging transducer is associated with the apparatus which senses some desired downhole condition and produces a signal representative of same. This signal is applied to the motor through control circuitry in the housing to control operation of the rotor and thereby encode the sensed information to the signal being produced by the valve.

The drive train comprises a transmission having a case. An input shaft is journaled in the case and is coupled at one end to the drive shaft of the motor. Affixed to the other end of the input shaft and substantially perpendicular thereto is a bevel gear which in turn drives two diametrically opposed disc gears whose axes are affixed to the case and which are perpendicular to the axis of the input shaft. Each disc gear has a helical thread gear integral on its inner surface. An output shaft which is coupled at one end to the rotor of the valve is journaled in the case and has a driving gear on its other end which is driven by the helical thread gears on the respective disc gears. Not only does the transmission provide the desired speed reduction between the motor and the valve but it also functions much in the same manner as a worm gear arrangement in that torque applied to the input shaft will efficiently drive the output shaft but torque applied to the output shaft will not drive the input shaft. This permits the valve to be designed to produce positive hydraulic torque under nominal mud conditions but prevents the hydraulic torque from being transmitted to the motor.

BRIEF DESCRIPTION OF THE DRAWINGS

The actual operation and the apparent advantages of the present invention will be better understood by referring to the drawings in which.

DESCRIPTION OF THE PREFERRED EMBODIMENT

As is well known in the art, an earth drilling apparatus (not shown) normally includes a string of pipe, i.e., drill string, which carries a drill bit at its lower end. The drill string can be rotated by power means at the surface or the drill bit can be rotated by a downhole power means, e.g., turbodrill, to effect the drilling of a well. Drilling fluid or mud is pumped down the drill string, out openings in the bit, and back to the surface through the annulus formed between the drill string and the wall of the well being drilled. The present invention relates to an apparatus which is positioned downhole in the drill string to sense and telemeter downhole information to the surface during drilling operations by means of an acoustical pressure wave generated in the drilling mud.

Figure 1:
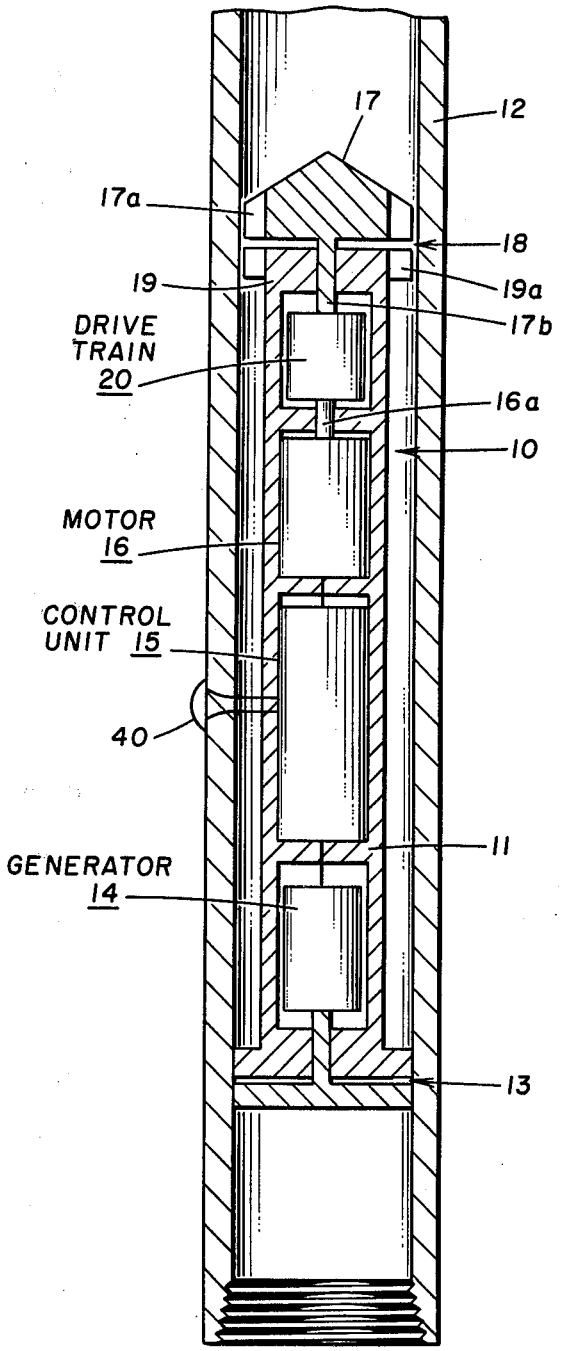
FIG. 1 is a schematical elevation, partly in section, of a logging-while-drilling apparatus in accordance with the present invention.

Referring more particularly to the drawings, FIG. 1 discloses a logging-while-drilling apparatus 10 having a housing 11 which is positioned within drill collar 12. As is well known in the art, collar 12 is threaded at both ends so that it can be coupled into and form part of a drill string in an earth drilling apparatus. Located at the lower end of housing 11 is a mud turbine 13 which is driven by the drilling mud as it flows through collar 12 during drilling operations. Turbine 13 in turn drives electrical generator 14 which supplies the electrical power necessary for operation of apparatus 10. Electricity from generator 14 is supplied through control unit 15 to motor 16 which in turn drives rotor 17 of signal-generating means, e.g., valve 18, through drive train 20.

Rotor 17 has slots **17*a* therethrough which when misaligned with slots 19*a* through stator 19 will cause the flow of drilling mud through valve 18 to be at least partially interrupted. This opening and closing of valve 18 causes an acoustical pressure wave signal to be generated in the drilling mud. The speed at which rotor 17** rotates determines certain characteristics, e.g., frequency and phase state, of the acoustical pressure wave being generated.

At least one transducer means which is capable of measuring a desired downhole condition and converting said measurement into a corresponding electrical signal is positioned downhole on or near apparatus 10. As illustrated, transducer means 40, e.g., strain gauge, is positioned on drill collar 12 to measure the downhole weight-on-bit. The signal from transducer means 40 is applied to control unit 15 from which it is encoded into the signal generated by valve 18.

One method of encoding the information into the acoustical pressure wave, including details of control unit 15, is disclosed and described in inventor's U.S. Pat. No. 3,789,355, issued Jan. 29, 1974. In logging-while-drilling tools of the type disclosed in U.S. Pat. No. 3,789,355, the signal-generating valve is preferably designed to produce no hydraulic torque at nominal mud conditions. The motor supplies all the power both (1) to rotate the valve at a constant speed to generate a defined pressure wave, and (2) to speed up and slow down the valve to effect the necessary phase shifts for encoding information into the signal. A highly efficient, speed reduction drive train of the type disclosed in U.S. Pat. No. 3,705,603, issued Dec. 12, 1972, is normally used in such tools to connect the motor to the valve. This type of drive train transmits torque from input to output and from output to input with substantially the same high efficiency so that any hydraulic torque produced by the valve is inherently transmitted through the drive train to the motor and may cause dynamic loading of the motor under certain conditions.

Drive train 20 of the present invention includes an asymmetrically efficient speed reduction transmission 21 (FIG. 2) which couples drive shaft **16*a* of motor 16 to rotor shaft 17*b* of valve 18 to allow torque to be efficiently transmitted from motor 16 to rotor 17 but which, also, effectively isolates motor 16 from the hydraulic torque produced by valve 18. This allows valve 18 to be designed so that its turbine characteristics will produce sufficient hydraulic torque under nominal mud conditions to rotate rotor 17 at a desired, constant speed to generate a constant, phase-locked pressure wave in the mud since the torque produced by the valve does not affect the motor even if mud conditions change. This, in effect, unloads motor 16 during normal operation and permits its full power to be utilized to effect the necessary acceleration and deceleration of rotor 17** required for the desired phase shifts in the generated signal.

Figure 2:
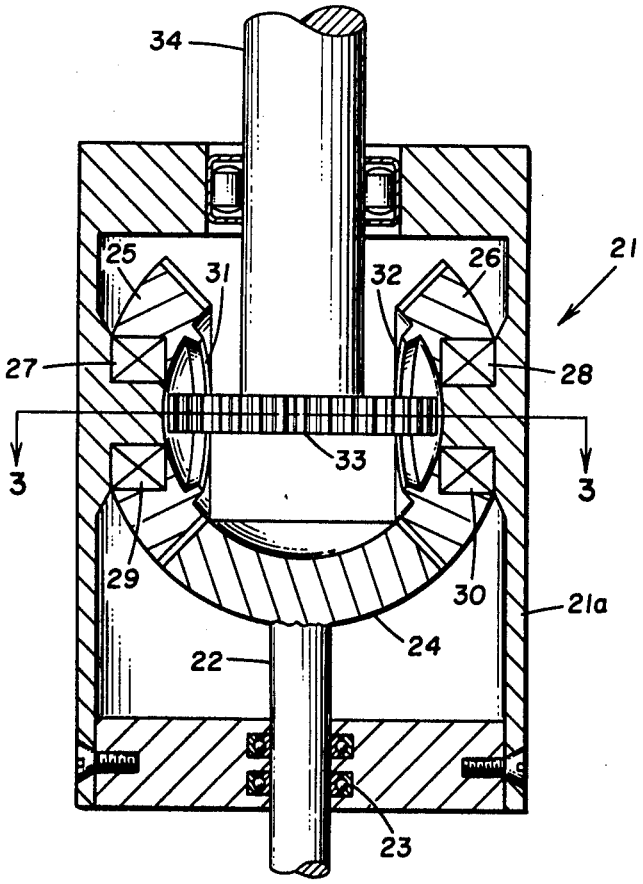
FIG. 2 is a detailed sectional view of the transmission in the drive train of the present invention.
Figure 4:
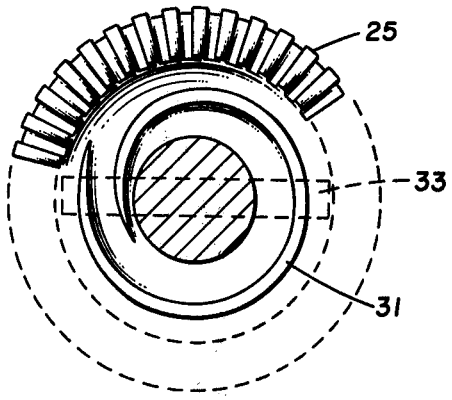
FIG. 4 is a sectional view taken along section line 4—4 of FIG. 3.
Figure 3:
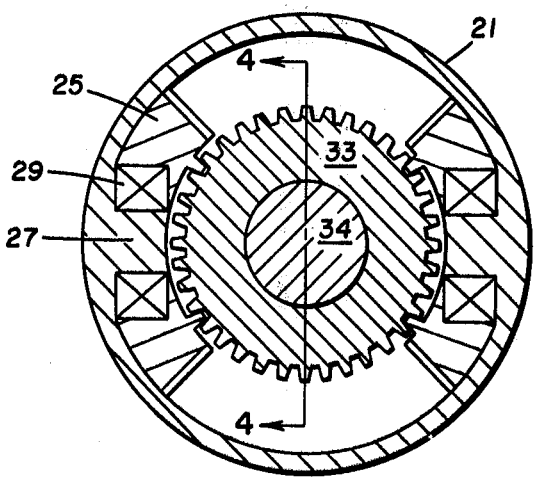
FIG. 3 is a sectional view taken along section line 3—3 of FIG. 2.

As shown in FIGS. 2–4, transmission 21 is comprised of case **21*a* having input shaft 22 journaled in one end by means of bearings 23. Input shaft 22 is adapted to be connected at one end to drive shaft 16*a* of motor 16 and to carry bevel driving gear 24 at the other end. Bevel driving gear 24 meshes with and drives two diametrically opposed disc gears 25, 26, which are journaled on axes 27, 28, respectively, by means of bearings 29, 30, respectively. Disc gears 25, 26** have helical thread gears 31, 32, formed or affixed to their inner surfaces, respectively, which mesh with and drive driven gear 33 on output shaft 34. Output shaft 34 is adapted to be connected to rotor shaft 17*b*.

In operation, motor 16 drives input shaft 22. A safety clutch (not shown), such as described in U.S. Pat. No. 3,705,603, is preferably installed between drive shaft 16*a* and input shaft 22 to protect the motor and drive train in the event valve 18 should jam. Input shaft 22 through driving gear 24 rotates both disc gears 25, 26, thereby causing helical thread gears 31, 32, respectively, to drive output shaft 34 through driven gear 33. Helical thread gears 31, 32 act in the same manner as a worm gear in that when thread gears 31, 32 are rotated, they will drive driven gear 33 with good efficiently, e.g., 50%. However, torque applied to driven gear 33 will not rotate helical thread gears 31, 32.

As seen from the above description, the present invention provides a logging-while-drilling apparatus which when utilizing phase shift keying encoding for transmitting downhole information has the following motor torque properties.

In phase lock, constant speed operation, excessive hydraulic torque generated by valve 18 is dissipated in gear train 20 such that motor 16 supplies power to run itself and acts as an "infinitely efficient brake" against any excess hydraulic torque. In the phase shifting mode, motor 16 must accelerate and decelerate. During acceleration, the hydraulic torque helps to accelerate rotor 17 on the output side of gear train 20 but cannot be transferred back through gear train 20; consequently, motor 16 must supply all power for its own running and acceleration. In the typical case where hydraulic torque will give acceleration to rotor 17 less than the motor gives to itself, then motor 16 will transfer torque through gear train 20 with good efficiency, e.g., 50%. The net acceleration properties are very good. In the deceleration mode, the hydraulic and inertia torques of the output side of gear train 20 are dissipated in transmission 21, thus neither adding to nor subtracting from the motor torque. Motor 16 supplies power for all its own deceleration.

The total result is that the regulation during phase lock is superb and that during phase shifting, all the motor power is used to accelerate and decelerate itself, giving fast phase shifts.

What is claimed is:

1. A logging-while-drilling tool comprising:
   - a housing adapted to be positioned in a drill string of an earth drilling apparatus wherein a drilling fluid which is circulated through the drill string will flow around said housing;
   - a rotary valve positioned on said housing so that at least a portion of the drilling fluid flowing through the drill string will flow through said valve, said valve having a shaft journaled in said housing;
   - a motor in said housing having a drive shaft and an operating characteristic determined by a downhole condition measured by said tool; and
   - a drive train connecting said drive shaft of said motor to said shaft of said rotary valve, said drive training comprising:
     - an asymmetrical efficient transmission for transmitting torque from said drive shaft of said motor to said shaft of said rotary valve and for preventing transmission of torque from said shaft of said rotary valve to said drive shaft of said motor; said transmission comprising:
     - a case;
     - an input shaft journaled in said case connected to to said drive shaft of said motor;
     - an output shaft journaled in said case connected to said shaft of said rotary valve;
     - a driving gear affixed to said input shaft;
     - at least one disc gear means journaled about an axis on said case perpendicular to the axis of said driving gear, said at least one disc gear being driven by said driving gear;
     - a helical thread gear carried by said at least one disc gear; and
     - a driven gear affixed to said output shaft and being driven by said helical thread gear.

2. The logging-while-drilling apparatus of claim 1 wherein said gear means includes:
   - more than one disc gear journaled on respective axes on said case, each of said disc gears including a helical thread gear which meshes with said driven gear on said output shaft.

* * * * *